US009382099B2

(12) United States Patent
Aquino et al.

(10) Patent No.: US 9,382,099 B2
(45) Date of Patent: Jul. 5, 2016

(54) MOTORIZED HEIGHT ACCESS DEVICE FOR TOWER CRANES

(71) Applicant: Manitowoc Crane Group France SAS, Ecully (FR)

(72) Inventors: François Aquino, Pouilly-sous-Charlieu (FR); Arnaud Jaouen, Sain Bel (FR); Michel Lissandre, Sain Bel (FR); Guillaume Reymond, Montilly (FR); Jacky Valleyre, Vougy (FR)

(73) Assignee: Manitowoc Crane Group France SAS, Ecully (FR)

( * ) Notice: Subject to any disclaimer, the term of this patent is extended or adjusted under 35 U.S.C. 154(b) by 194 days.

(21) Appl. No.: 13/829,580

(22) Filed: Mar. 14, 2013

(65) Prior Publication Data

US 2013/0240297 A1 Sep. 19, 2013

(30) Foreign Application Priority Data

Mar. 15, 2012 (EP) ..... 12305304

(51) Int. Cl.
*B66C 13/54* (2006.01)
*B66B 9/00* (2006.01)
(Continued)

(52) U.S. Cl.
CPC ... *B66B 9/00* (2013.01); *B66B 9/16* (2013.01); *B66C 13/54* (2013.01); *B66C 23/56* (2013.01); *E04G 3/30* (2013.01); *E04H 12/34* (2013.01); *B66F 11/04* (2013.01)

(58) Field of Classification Search
CPC ..... B66C 13/54; B66B 9/16; E04G 3/28; E04G 2003/286; E04G 3/325
USPC ..... 182/128, 141, 146, 148, 150; 187/401, 187/900, 240; 212/290, 291
See application file for complete search history.

(56) References Cited

U.S. PATENT DOCUMENTS 3,080,981 A * 3/1963 Kuschel ..... B66C 13/54 182/146
3,166,154 A * 1/1965 Titzel ..... 182/128
(Continued)

FOREIGN PATENT DOCUMENTS

CH 665825 6/1988
EP 0175052 3/1986
(Continued)

OTHER PUBLICATIONS

Definitions of 'manual', 'lock', 'couple', 'join', and 'connect' found in Action The American Heritage® Dictionary of the English Language, Fourth Edition copyright © 2000 by Houghton Mifflin Company. Updated in 2009. Published by Houghton Mifflin Company. All rights reserved.*
(Continued)

*Primary Examiner* — Daniel Cahn
(74) *Attorney, Agent, or Firm* — Brinks Gilson & Lione; Craig Buschmann

(57) ABSTRACT

A height access device enables motorized access to the driving station of a tower crane atop a mast formed of superposed mast elements. It includes a lift cabin installed inside the mast of the crane and movable vertically along the mast. The height access devices further includes a working platform positioned above and separably connected to the lift cabin. A coupling device provides a non-permanent connection of the working platform to the lift cabin and immobilizes the working platform relative to the mast at a required height. The height access device enables the crane driver to ascend and descend with the lift cabin alone when disconnected from the working platform and with the lift cabin and working platform together, particularly during the assembly and dismantling of the mast.

13 Claims, 8 Drawing Sheets

(51) Int. Cl.

| | |
|---|---|
| ***B66B 9/16*** | (2006.01) |
| ***E04G 3/30*** | (2006.01) |
| ***E04H 12/34*** | (2006.01) |
| ***B66C 23/00*** | (2006.01) |
| *B66F 11/04* | (2006.01) |

(56) References Cited

U.S. PATENT DOCUMENTS

| | | | | |
|---|---|---|---|---|
| 3,439,467 | A * | 4/1969 | Partlow | 52/632 |
| 5,159,993 | A * | 11/1992 | St-Germain | 182/82 |
| 7,665,582 | B2 * | 2/2010 | Lindh | 187/401 |
| 8,585,324 | B2 * | 11/2013 | Palfinger | 405/196 |
| 2003/0213647 | A1 * | 11/2003 | St-Germain | B66B 7/027 182/141 |
| 2003/0217984 | A1 * | 11/2003 | Lissandre | B66C 13/54 212/291 |
| 2005/0006177 | A1 * | 1/2005 | Korchagin et al. | 187/239 |
| 2007/0119331 | A1 * | 5/2007 | Korchagin et al. | 104/307 |
| 2007/0271863 | A1 * | 11/2007 | Lindh | 52/239 |
| 2008/0230321 | A1 * | 9/2008 | Csaszar | B66B 9/16 187/244 |

FOREIGN PATENT DOCUMENTS

| | | | |
|---|---|---|---|
| FR | 2 468 541 | A1 | 5/1981 |
| FR | 2 936 236 | A1 | 3/2010 |
| WO | WO 92/18412 | | 10/1992 |
| WO | WO 2005/087645 | | 9/2005 |

OTHER PUBLICATIONS

I Search Report for EP 12 305 304.3 (priority document).

* cited by examiner

Fig. 2
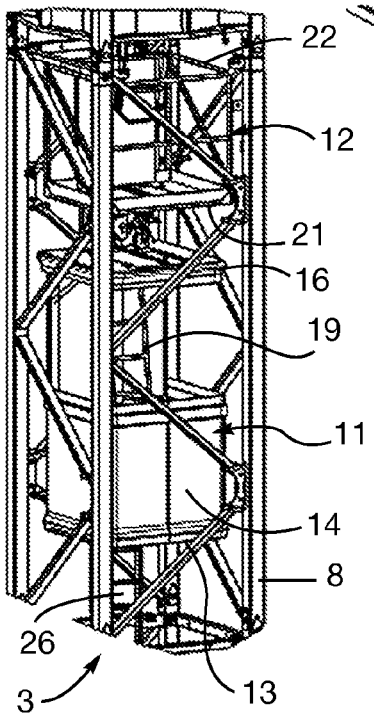
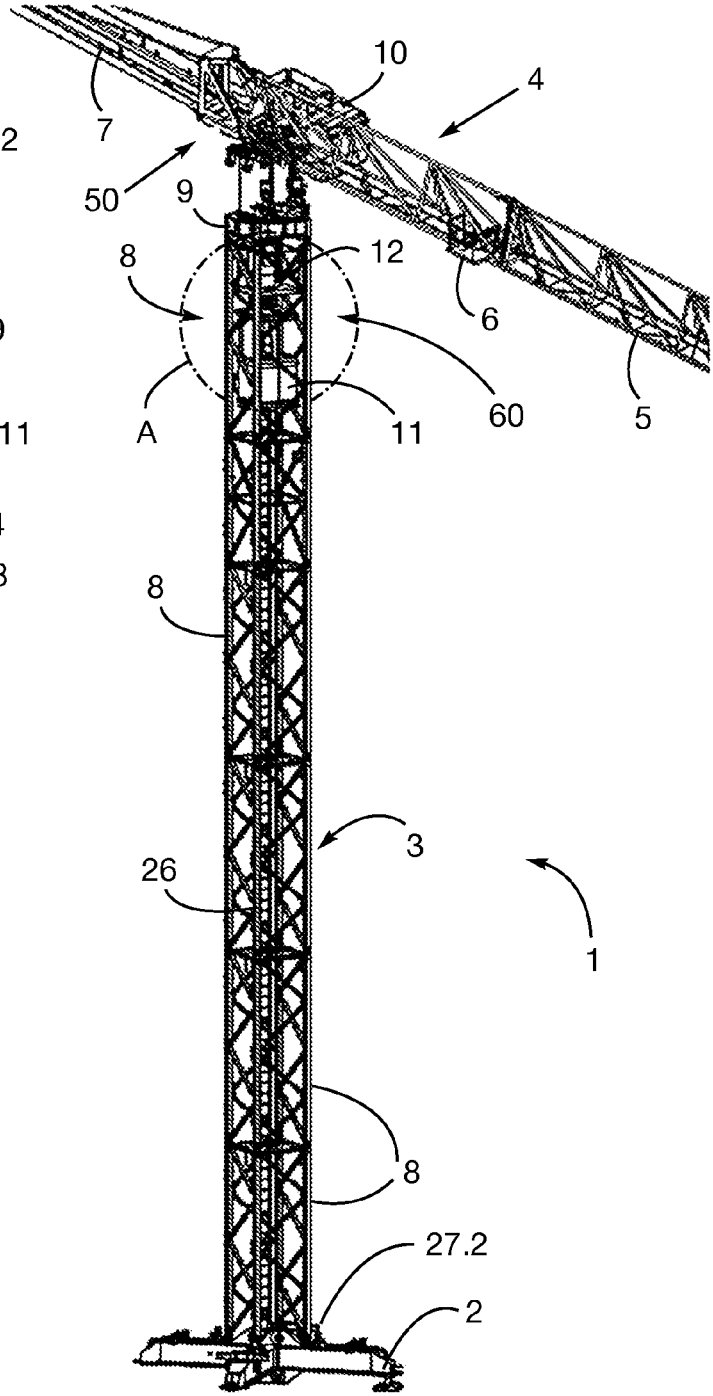
Fig. 1

Fig. 7
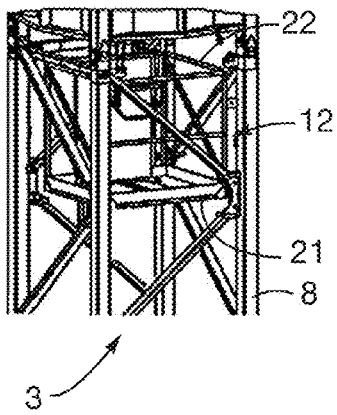
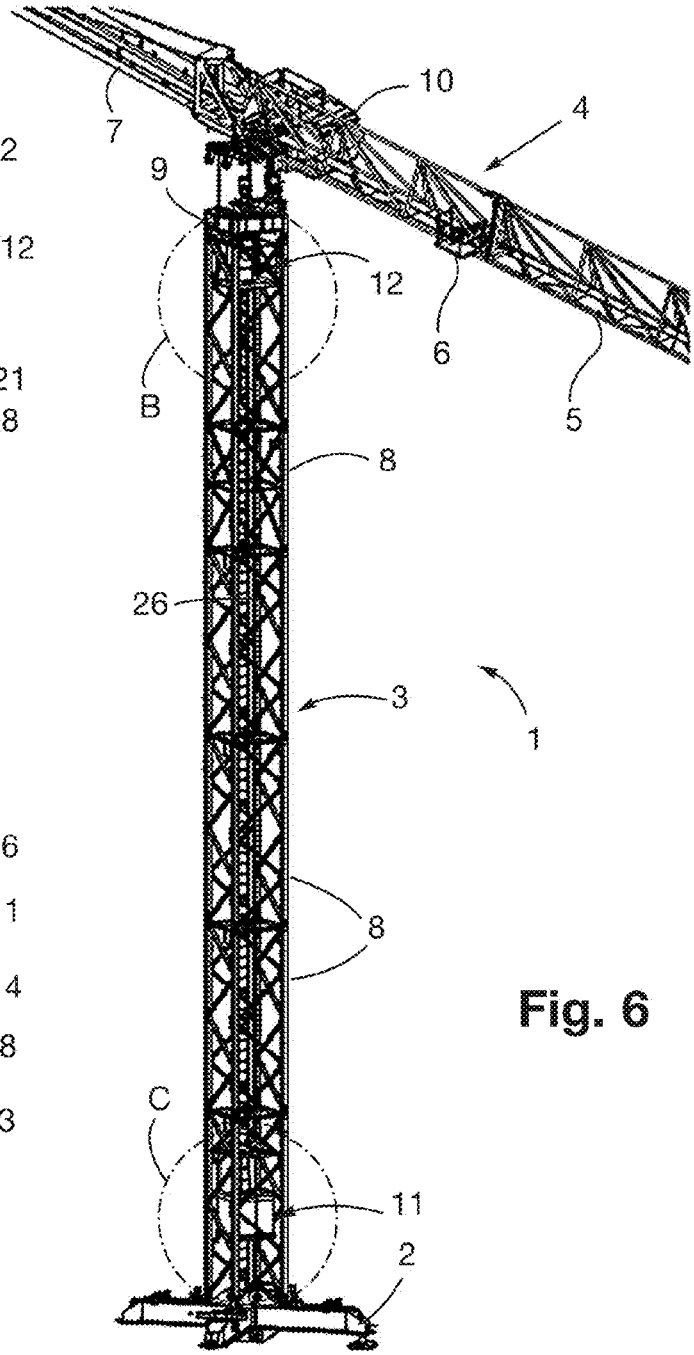
Fig. 6
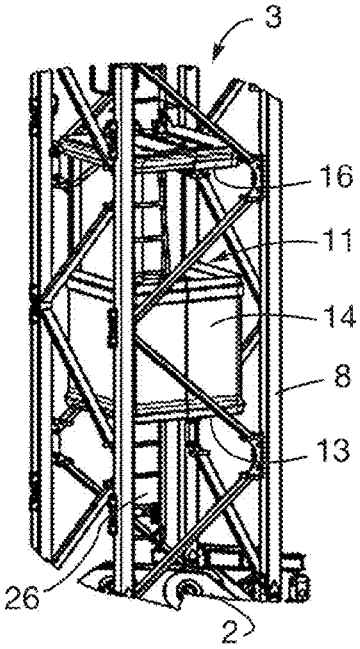
Fig. 8

Fig. 12
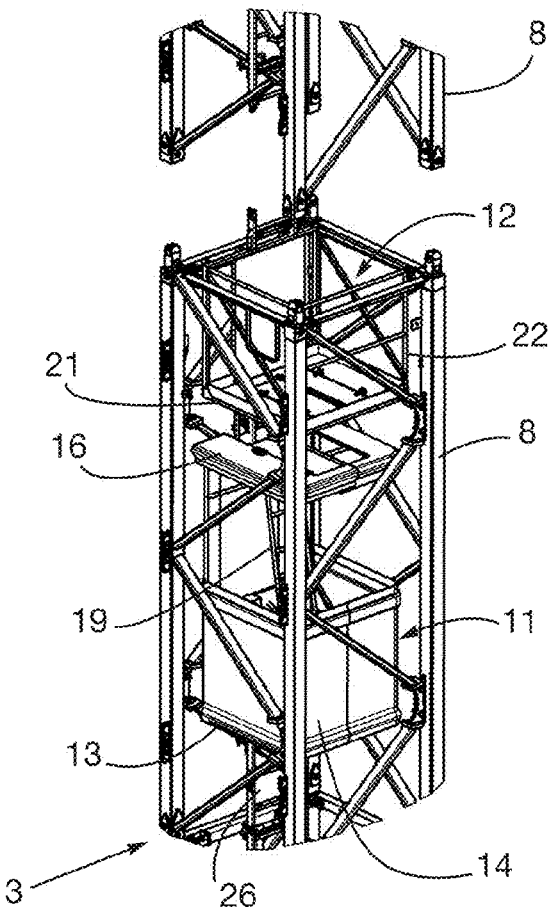
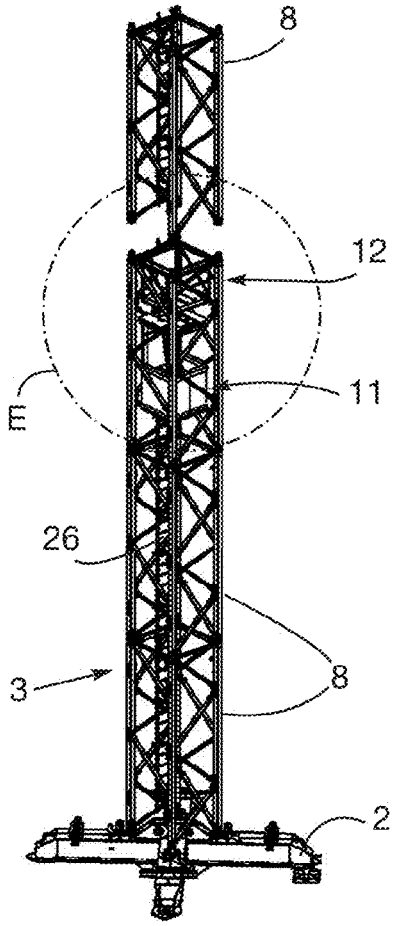
Fig. 11

MOTORIZED HEIGHT ACCESS DEVICE FOR TOWER CRANES

RELATED APPLICATIONS

The present patent document claims the benefit of priority to European Patent Application No. 12305304.3, filed Mar. 15, 2012, and entitled "MOTORIZED HEIGHT ACCESS DEVICE FOR TOWER CRANES," the entire contents of which are incorporated herein by reference.

BACKGROUND

The present invention concerns suspended load lifting apparatus, and more particularly tower cranes. This invention is even more particularly relevant to a motorized height access device for a tower crane enabling:

- on the one hand, the crane driver to reach quickly, without effort or fatigue, a driving cab situated in the high part of the tower crane;
- on the other hand, operators to access various heights during operations of mounting or dismantling the structure of the tower crane or for other work.

A tower crane conventionally comprises a vertical mast at the top of which is mounted a boom turning about a vertical axis. Along the boom moves a carriage, below which the load to be lifted is suspended from a hook. The driving cab of such a tower crane is usually formed of a cabin situated in the region at or near the top of the mast and thus at a great height above the ground.

In most tower cranes access to the driving cab for the crane driver is by way of rail-ladders installed inside the mast of the tower crane. There may be a vertical ladder with a protective safety cage, or "crinoline," or multiple oblique ladders connecting resting landings disposed at regular vertical intervals.

The main drawbacks of this traditional mode of access are the necessity for a large physical effort by the crane driver to ascend the mast to the cabin and the long time necessary to ascend to the cabin and conversely to descend to the ground, which reduces the productivity of the site on which the tower crane is used.

To avoid these drawbacks motorized height access solutions have already been proposed. These solutions typically consist of providing a "lift" or elevator that is installed and moves either on the outside of the mast or on the inside of the mast.

Motorized solutions on the outside of the mast still have many drawbacks:

- The access device, otherwise known as the lift, must be installed on the mast after assembling the tower crane. Having to wait until the tower crane is assembled to then install the lift increases the time to assemble the combination of the tower crane and its lift.
- The presence of a lift on the outside of the mast is incompatible with the use of a telescoping cage, which also is situated on the outside of the mast.
- The presence of an outside lift increases the cross-section of the tower crane exposed to winds, which can limit the working height of the tower crane.
- The presence of an outside lift also entails the risk of the lift colliding with bulky loads suspended from the hook of the tower crane.
- In the case of a lift moved by a rack and pinion mechanism, such a mechanism is incompatible with any movement or swaying of the mast, which is overcome by providing an intermediate mast on which the lift will move.

- In the case of a lift drawn by a cable, an upper fixed point outside the mast must be provided.
- There is often a challenge for persons to move between the lift positioned on the outside of the mast and the inside of the mast.

The patent documents CH665825 and EP 0 175 052, as well as the patent document WO 2005/087645, provide examples of motorized solutions on the outside of the mast in which the lift cabin on the outside of the mast is accessed by a working platform.

Accordingly, motorized solutions inside the mast of the tower crane appear preferable for avoiding the drawbacks indicated above. Such solutions are described in the patent documents WO 92/18412 and FR 2 936 236.

In the case of the document WO 92/18412, a simple lift cabin is mounted and moves inside a safety cage that is installed inside the mast. The lift cabin is guided along the ladder and is moved by a rack and pinion mechanism, the rack preferably being carried by the ladder.

In the case of the document FR 2 936 236, a lift cabin is mounted to move on a vertical guide rail inside the mast, the guide rail being equipped with a rack for moving the lift cabin. This lift cabin is surmounted by a working platform surrounded by a guard rail. The lift cabin and its working platform cannot be separated. The mast of the tower crane is formed by the superposition of a certain number of mast elements and the combination consisting of the lift cabin and the working platform can be located entirely inside the bottom mast element, where it is installed for the transport of the dismantled tower crane. A trapdoor through which a vertical ladder passes provides access between the inside of the lift cabin and the working platform surrounding the cabin.

In such an embodiment, however, the permanent fastening together of the working platform and the lift cabin has drawbacks including, in particular:

- The lift cabin and the platform surrounding this cabin makes it obligatory to vertically move a large mass and a large volume resulting from each time the crane driver ascends or descends.
- Most importantly, the solution from the document FR 2 936 236 creates an undesirable situation because the platform remains with the lift. When the lift cabin is in the bottom position at the base of the tower crane or moving along the mast the platform moves with the lift. This, however, means there is not a platform adjacent the driving cab, which leaves a large gap at the level of the driving cab of the tower crane, regardless of whether or not anyone is working in this area.
- When the tower crane is in service, the platform and the lift cabin are situated in the upper part of the mast, with the result that the cross-section of the tower crane exposed to winds is increased because of the presence of the lift cabin at a great height above the ground.
- If the working platform must be stopped at intermediate heights for particular work to be carried out or during operations of mounting or dismantling the tower crane, the lift cabin is necessarily stopped at the same level as the platform and is no longer usable for operators to ascend or descend.

BRIEF SUMMARY

Embodiments of the present invention aim to avoid these drawbacks by providing an improved motorized height access device particularly suitable for the practical requirements of a tower crane. In addition, embodiments of the present invention disclose a motorized height access solution inside the mast that is safe and adaptable in its uses, particularly by facilitating the operations of assembling and dismantling the tower crane.

To this end, various embodiments pertain to a motorized height access device for a tower crane. The motorized height access device includes a lift cabin that is installed inside the mast of the tower crane that is movable vertically along the mast. The lift cabin is surrounded by a working platform with a guard rail. The working platform is configured to be arranged inside the mast of the tower crane. The working platform is separably connected to the lift cabin through a coupling device configured for non-permanent connection of the working platform to the lift cabin and for immobilizing the working platform relative to the mast at a required height. Such motorized height access devices permit the use of the lift cabin travel separately from the working platform.

Thus, an aspect of the invention comprises a working platform that surrounds the lift cabin and is separable from the lift cabin. Embodiments of such a platform make it possible:

- to maintain the working platform at the height of the driving cab of the tower crane, and thus at the top of the mast just below the rotatable boom of the tower crane, the lift cabin then being separated from the working platform to enable the crane driver to ascend at the start of a shift in order to access his or her workstation quickly, without effort or fatigue, and to descend at the end of the shift;
- to bring the working platform, when attached to the lift cabin, to any height required for occasional work and most importantly for operations of assembling and dismantling a tower crane that includes a mast formed of superposed mast elements to be assembled or disassembled.

A further advantage of embodiments of the invention include the fact that when the lift cabin is raised or lowered the working platform optionally remains in position at the top of the mast under the boom and proximate the driving cab, allowing persons to circulate more safely in that area. Without the working platform coupled to the lift cabin, the overall weight and size of the lift cabin to be vertically moved is less than it would otherwise have been with the working platform coupled to the lift cabin.

Moreover, when the tower crane is in service, the lift cabin may return to the base of the tower crane while the working platform remains immobilized in the upper part of the mast. The tower crane then has a smaller cross-section exposed to winds.

For transporting the tower crane to a worksite the lift cabin coupled to the working platform may be brought with the working platform within the overall size of lowered to and contained within the bottom of the mast element, which helps to protect the device during transportation of the tower crane.

Of course, embodiments of the invention retain all of the advantages of height access solutions positioned inside the mast, particularly the protection of the lift cabin when it is in vertical motion within the mast. As noted, positioning the lift cabin and working platform within the mast reduces the risk of a collision with a load suspended from the hook.

The coupling device provides a non-permanent connection of the working platform to the lift cabin and for immobilizing the working platform relative to the mast at a required height may be manually operated or motorized. The manual coupling device must be accessible from inside the lift cabin, from the working platform, or, where applicable, via a trapdoor. Regardless of whether or not the coupling device is manually operable or motorized, it should be simple and safe to operate.

In one embodiment, the lift cabin includes a bottom trapdoor at the level of the lift cabin's floor, a top trapdoor provided in the lift cabin's roof, and an inclined or vertical interior ladder, while the working platform has a platform floor with an opening equipped with a trapdoor positioned to open onto the top trapdoor of the lift cabin. The interior ladder of the lift cabin may be provided with an intermediate ledge, particularly those embodiments that include an inclined ladder. The interior ladder enables a passenger in the lift cabin to access the working platform from the lift cabin. The interior ladder optionally is configured to limit the directions from which the bottom trapdoor is accessed, minimizing the risk that something or someone (such as a passenger that has taken ill) will block access to the trapdoor in the floor or prevent the trapdoor from being opened from below.

The manual coupling device for non-permanent connection of the working platform to the lift cabin may include a latch that can be actuated manually via the top trapdoor of the lift cabin. When the latch is not engaged to couple the working platform to the lift cabin the latch is configured to engage a ladder within the mast of the tower crane.

In some embodiments, the latch is connected to an electrical switch adapted to determine a reduced speed or a non-reduced speed of movement of the lift cabin. The electrical switch permits a non-reduced speed when the latch is not connecting the working platform to the lift cabin. Thus, just the lift cabin can move at a relatively high speed; conversely, when the working platform is connected to the lift cabin the electrical switch permits the connected lift cabin-working platform to move only at low or reduced speed.

In one embodiment, the aforementioned manual coupling devices includes a lever mechanism that is actuated by a rod that can be manipulated from inside the lift cabin.

The invention will be better understood in the light of the following description with reference to the appended diagrammatic drawings representing, by way of example, an embodiment of this height access device for a tower crane.

BRIEF DESCRIPTION OF THE DRAWINGS

FIG. 1 is a general view in perspective of a tower crane equipped with an access device according to the present invention, the lift cabin and the working platform being situated at the top of the mast;

FIG. 2 represents to a larger scale the detail A from FIG. 1, with the lift cabin connected to the working platform;

FIG. 6 is a general view similar to FIG. 1 but with the working platform at the top of the mast and the lift cabin at the bottom of the mast;

FIG. 7 represents to a large scale the detail B from FIG. 6 with the working platform at the top of the mast;

FIG. 8 represents to a larger scale the detail C from FIG. 6 with the lift cabin at the bottom of the mast;

FIG. 11 is a perspective view of the tower crane during assembly, using an embodiment of the invention;

FIG. 12 represents to a larger scale the detail E from FIG. 11, with the lift cabin connected and fastened to the working platform at the top of a section of the mast being assembled;

DETAILED DESCRIPTION

Figure 3:
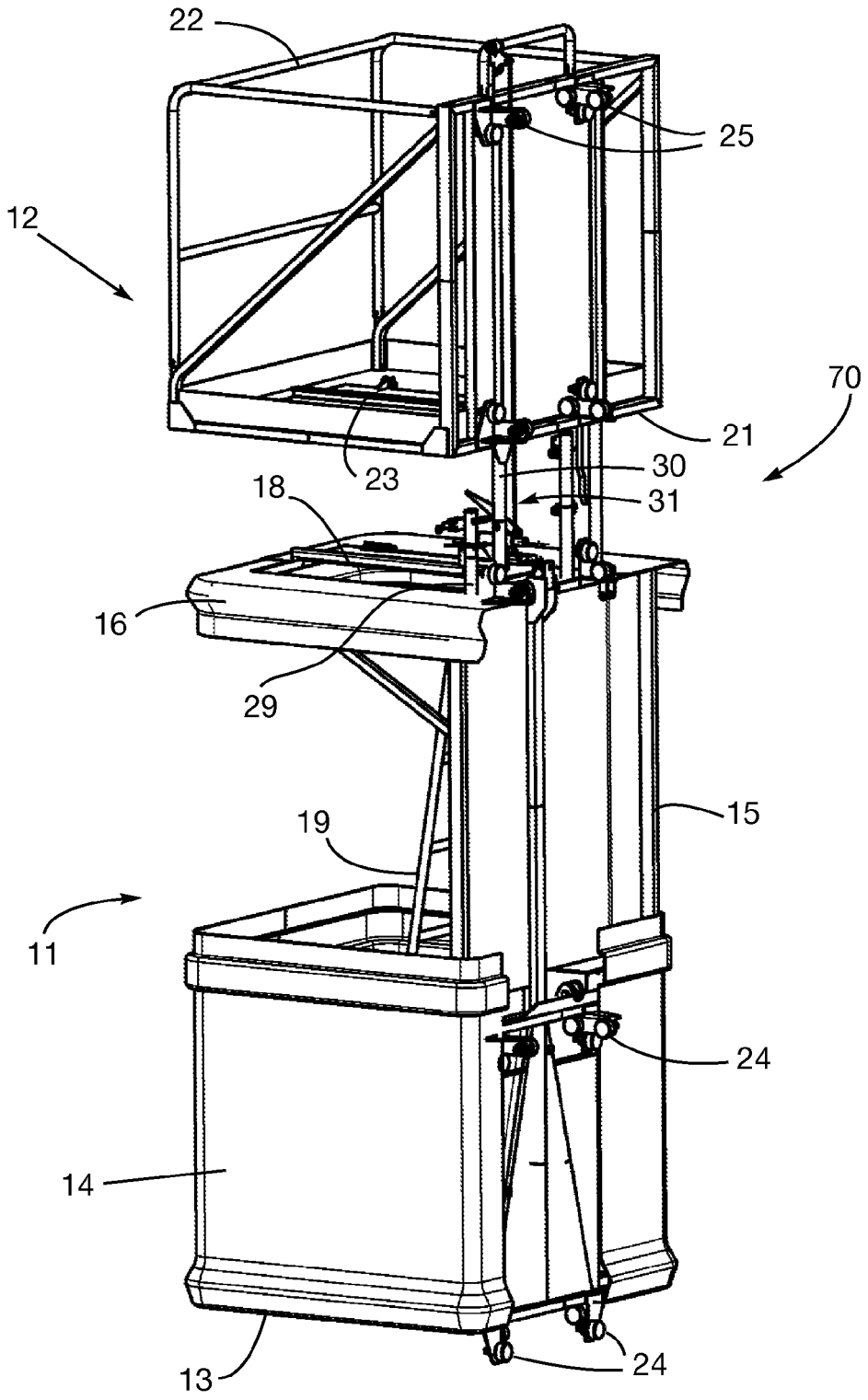
FIG. 3 is a schematic perspective view showing the lift cabin connected and fastened to the working platform.

Referring to FIG. 1, it is seen that a tower crane 1 comprises a base frame 2, a mast 3 and a boom 4 that is rotatable to be oriented about a vertical axis. The boom 4 comprises:

- a distributor boom, or jib, 5 along which a carriage 6 moves;
- a counterboom, or counter-jib, 7 carrying a counterweight (not illustrated).

The mast 3 comprises a certain number of superposed mast elements 8, the top-most mast element 8 carrying a pivot 9 on which the boom 4 is rotatably mounted.

The tower crane 1 also has, in its upper part 50, a driving cab 10. In the example shown, the driving cab 10 is carried by the boom 4 and situated on one side of the distributor boom, or jib, 5.

Embodiments of the invention relate to a height access device 60 that enables personnel and, in particular, the crane driver to access the upper part 50 of the tower crane 1 and, in particular, the driving cab 10.

The height access device 60 comprises a lift cabin 11 and a working platform 12 on top of the lift cabin 11. The lift cabin 11 and the working platform 12 are here accommodated inside the mast 3 and are configured to be movable vertically along the mast 3, over practically all of the height of this mast 3.

Figure 5:
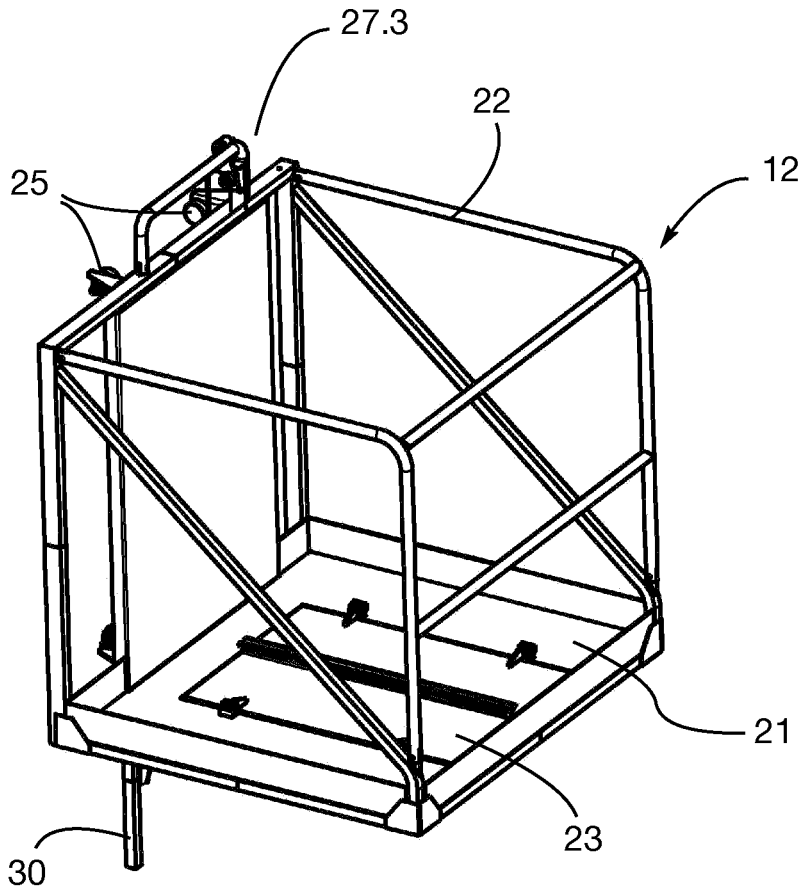
FIG. 5 is a schematic perspective view of the working platform alone, i.e. separated and unfastened from the lift cabin.

The working platform 12 is separably connected to the lift cabin 11. Thus, FIG. 3 shows the working platform 12 connected to the lift cabin 11, while FIG. 5 shows the same working platform 12 separated and isolated since disconnected from the lift cabin 11.

Figure 4:
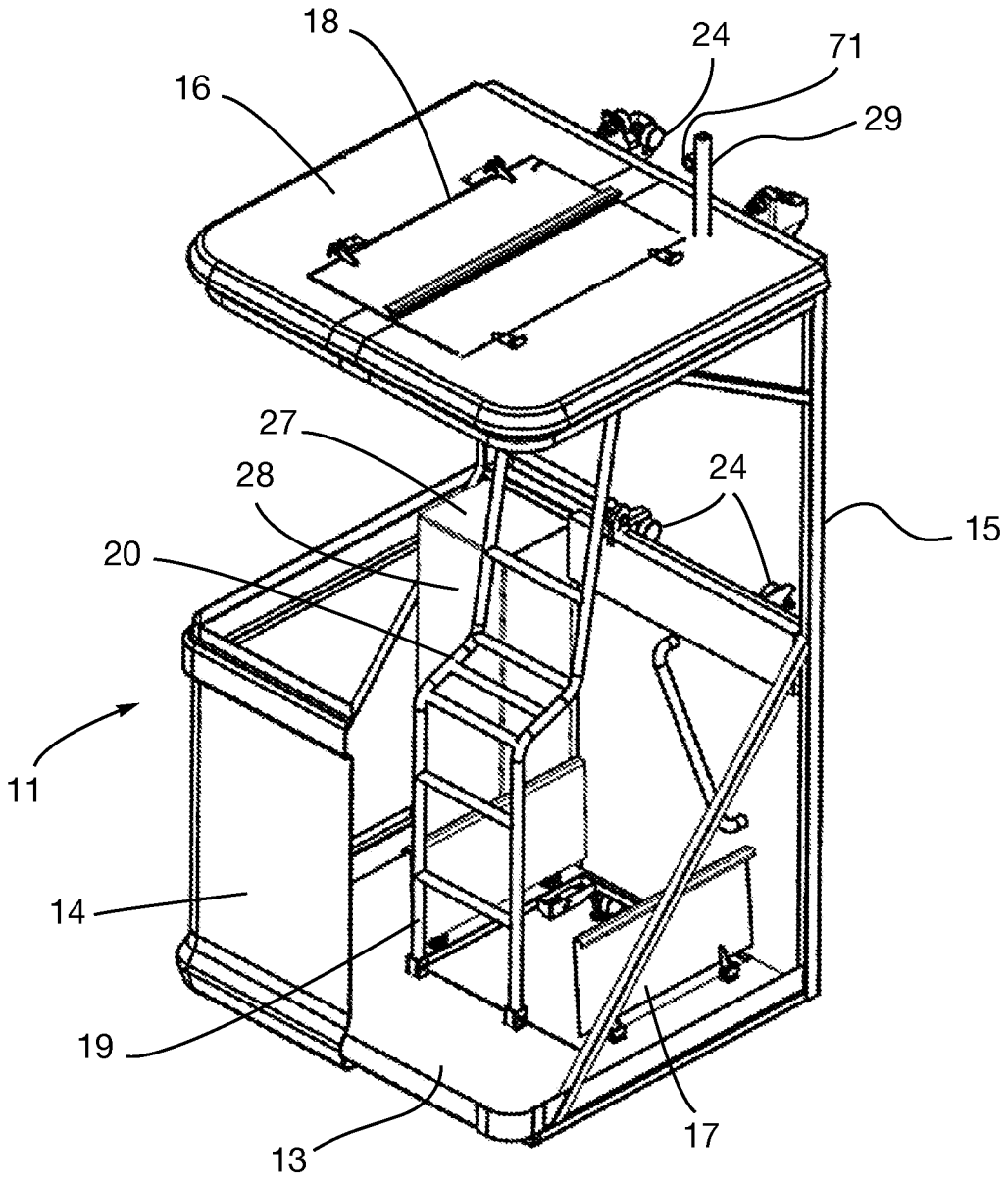
FIG. 4 is a schematic "cutaway" perspective view of the lift cabin alone while disconnected and unfastened from the working platform.

Referring to FIGS. 3 and 4, the lift cabin 11 includes a cabin floor 13 surrounded by a guard rail 14 and a framework 15 that support a protecting roof 16. The lift cabin optionally is equipped with a bottom trapdoor 17 in cabin floor 13 and a top trapdoor 18 in its roof 16. The lift cabin 11 further includes an interior ladder 19 which is inclined and which is provided with an intermediate ledge 20 that provides continuity of access between the bottom trapdoor 17 and the top trapdoor 18.

The working platform 12 also includes a platform floor 21 surrounded by a guard rail 22. In the platform floor 21 of the working platform 12 there is provided an opening equipped with a trapdoor 23 positioned to open onto the top trapdoor 18 of the lift cabin 11.

The lift cabin 11 and the working platform 12 are both equipped, on one of their sides, with respective guide rollers 24 and 25 provided for positioning and rolling of the lift cabin 11 and the working platform 12 on common guide rails (not illustrated) installed in the mast 3. The guide rails may comprise the rails or stiles of a rail-ladder 26 (FIG. 1) installed inside the mast 3, the rail-ladder 26 itself being formed of sections corresponding to the mast elements 8.

A motor is provided for propelling the lift cabin 11 along the guide rails. Control stations or consoles are provided for controlling the ascent and descent movements of the lift cabin 11, in particular with:

- a first control station 27 situated in the lift cabin 11, on top of an electrical cabinet 28 that controls the motor;
- a second control station 27.2 situated at the base of the tower crane 1;
- a third control station 27.3 situated on the working platform 12.

These first, second and third control stations 27, 27.2, and 27.3 may transmit control instructions by a wired connection or by a wireless connection to eliminate the problems of winding and unwinding cables as the lift cabin 11 ascends and descends.

As already mentioned, the working platform 12 is separably connected to the lift cabin 11, which enables the working platform 12 to move vertically with the lift cabin 11 or to be immobilized at a certain height whilst the lift cabin 11 is able to move. To this end, the lift cabin 11 and the working platform 12 are provided with a coupling device 70/80.

In the embodiment shown, the coupling device 70/80 is manually operated and comprises elements 29 projecting above the roof 16 of the lift cabin 11 and complementary elements 30 projecting below the platform floor 21 of the working platform 12. A lever mechanism 31 controls the coupling and/or uncoupling of the elements 29 and 30. This lever mechanism 31 can be actuated by a rod 32 that can be manipulated from inside the lift cabin 11.

Figure 14:
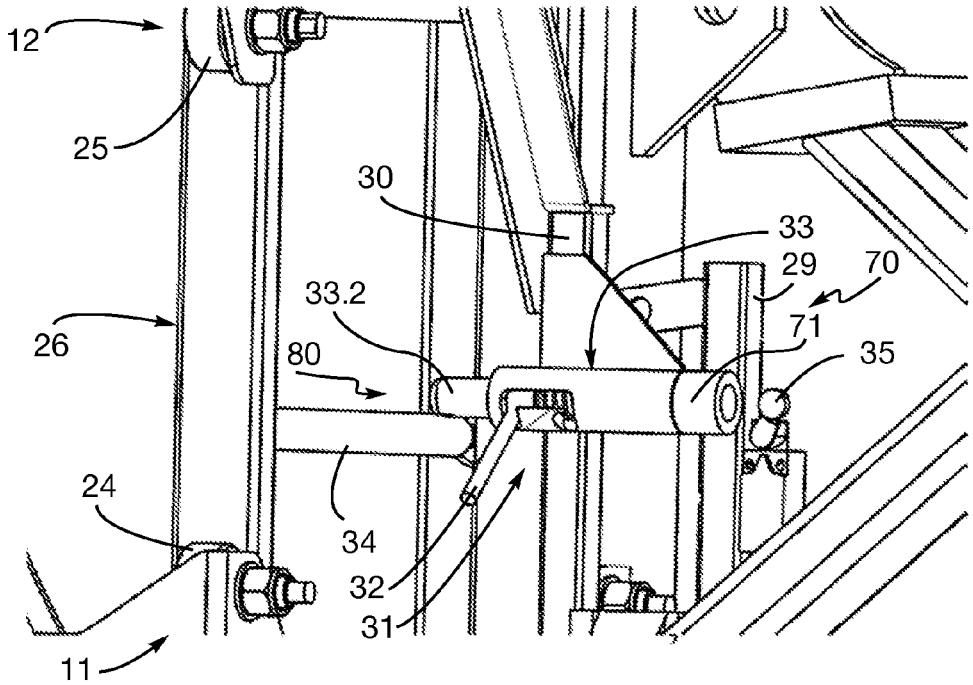
FIG. 14 is a perspective view showing in detail the coupling device between the working platform and the lift cabin in a locked position.

Because the working platform 12 is separable from the lift cabin 11, the coupling device 70/80 is configured for immobilizing the working platform 12 at a required height on the mast 3. An embodiment of the coupling device 70/80 takes the form of a latch 33 that can be engaged between the rungs 34 of the rail-ladder 26, as illustrated in FIG. 14.

The height access device 60 further includes various safety units: end of travel sensors operating when the lift cabin 11 reaches either one of the top and bottom position relative to mast 3, cabin ascent and descent obstacle sensor, overload sensor, cabin overspeed sensor and emergency brake, sensors associated with the various trapdoors 17, 18, and 23 that prohibit moving the lift cabin 11 if any of the trapdoors 17, 18, and 23 is not correctly closed, a manual back-up system usable in the event of failure of the motor, etc.

The lift cabin 11 and the working platform 12 are advantageously further equipped with a light source or sources, preferably with emergency electrical power supply, providing in particular for minimum lighting of the first 27, second 27.2 and third 27.3 control stations.

Referring to the various figures, the operation of the height access device 60 described above is as follows:

A first operating mode is the so-called "normal" mode, which applies during use of the tower crane 1 on a site, in particular to enable the crane driver to ascend to the top of the mast 3 in order to access the driving cab 10, and conversely to enable the crane driver to descend to the ground at the end of a shift. The lift cabin 11 is then separated from the working platform 12 and the working platform 12 is immobilized in the highest position, i.e. at the top of the mast 3 just below the boom 4.

To ascend at the start of a shift the crane driver, as appropriate:

- either accesses the lift cabin 11 already present at the base of the mast 3 directly,
- or if the lift cabin 11 is not present (e.g., the lift cabin 11 left in the top position), sends order to the lift cabin 11 by means of the second control station 27.2 situated at the base of the tower crane 1 to cause the lift cabin 11 to come to the bottom position.

In its bottom position (see FIGS. 6 and 8), the lift cabin 11 is stopped at a certain height, for example approximately two meters above the base frame 2 of the tower crane 1. The crane driver then accesses the lift cabin 11 by mounting the first rungs of the rail-ladder 26 and passing through the open bottom trapdoor 17 of the lift cabin 11. The crane driver must then close this bottom trapdoor 17 to enable the lift cabin 11 to move.

Figure 9:
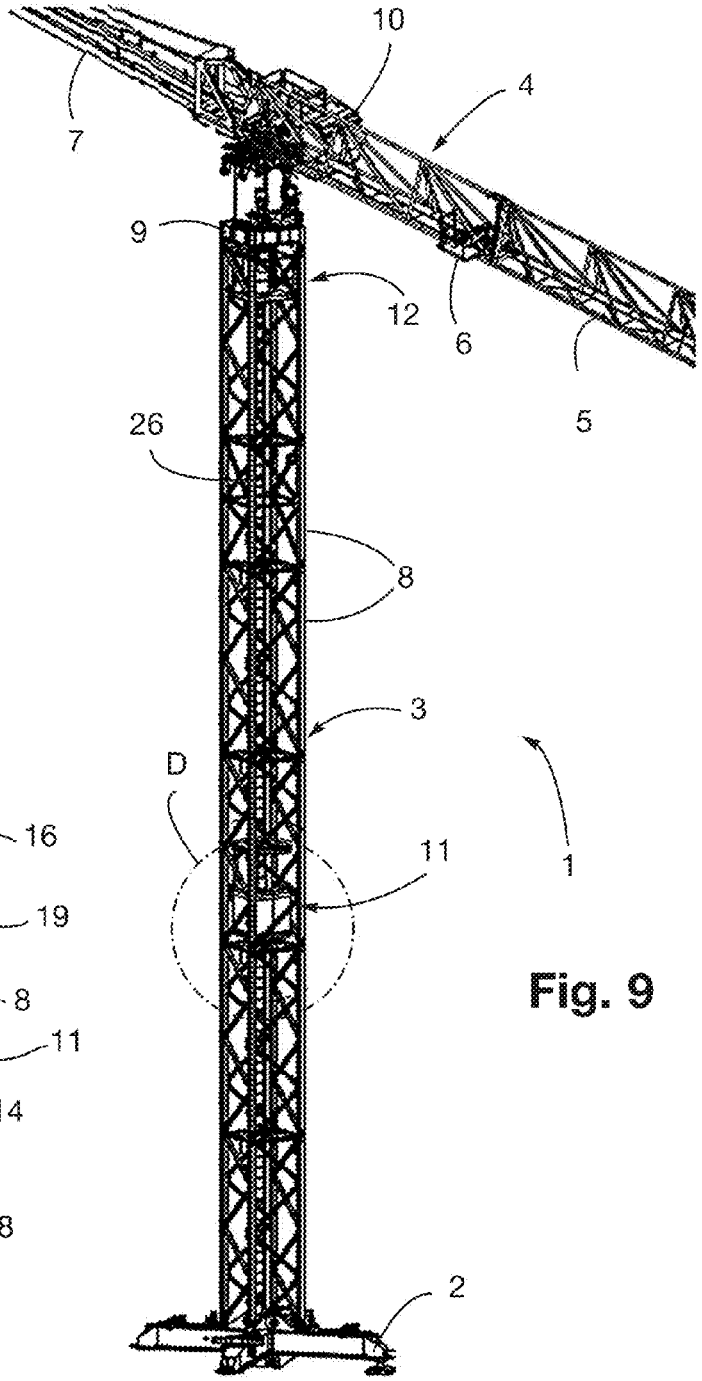
FIG. 9 is another general view similar to FIGS. 1 and 6 but with the working platform at the top of the mast and the lift cabin in an intermediate position along the mast.
Figure 10:
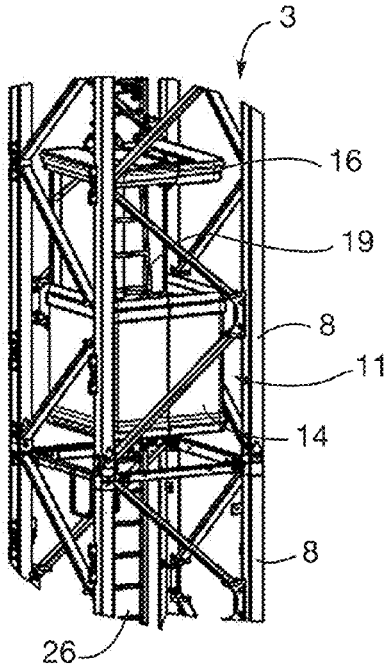
FIG. 10 represents to a larger scale the detail D from FIG. 9 with the lift cabin in the intermediate position along the mast.

The ascent of the lift cabin 11 is then controlled by way of the first control station 27 situated in the lift cabin 11. The crane driver can then:

- either interrupt the ascending movement of the lift cabin 11 at any time to proceed to operations such as verifying the tightness of the fishplates or connecting plates that join the mast elements 8 to each other (see FIGS. 9 and 10 showing the lift cabin 11 stopped in an intermediate position),
- or bring the lift cabin 11 directly to its top position, at which the lift cabin 11 stops just below the working platform 12 (see FIGS. 1 and 2).

The crane driver can then exit the lift cabin 11 via the top of the lift cabin 11 by climbing the interior ladder 19 and passing through the open top trapdoor 18 of the lift cabin 11 and the platform trapdoor 23 of the working platform 12. The crane driver thus reaches the platform floor 21 of the working platform 12 and from there can reach the boom 4 and, more particularly, the driving cab 10 or driving station.

At the end of the day (or other period) of work, the crane driver having left the driving cab 10 returns to the working platform 12 that has remained immobilized in the top position. From there the crane driver can access the lift cabin 11 directly if the latter has remained in the top position or ordering the lift cabin 11 from the third control station 27.3 situated on the working platform 12 if the lift cabin 11 is not present. The operations described are then effected in reverse order to those for ascending until the lift cabin 11 returns to and stops in the bottom position (FIGS. 6 and 8).

Another operating mode shown in FIGS. 11 and 12 corresponds to use during assembling or dismantling of the tower crane 1 and, more particularly, the mast 3 composed of superposed mast elements 8 that must be assembled successively to each other.

The lift cabin 11 is then fastened to the working platform 12. Initially, the height access device 60 comprising the lift cabin 11 and the working platform 12 is situated entirely within the bottom mast element 8.

As the mast 3 rises with the connection of additional mast elements 8, the height access device 60 can be brought by vertical movement to the level of the top mast element 8 at that time, i.e. the latest assembled mast element 8. One or two operators can then take up their station on the working platform 12 to receive the next mast element 8 in order to fit the members connecting this new mast element with the preceding one. After the adjacent mast elements 8 have been coupled together, the lift cabin 11-working platform 12 assembly is moved upward inside the new mast element, and so on. The process is continued until the mast 3 has reached the required height and the working platform 12 is finally immobilized at the top of the finished mast 3.

It will be noted that in this other operating mode the speed at which the lift cabin 11 moves may be lower than in the normal mode as previously noted. Moreover, the manner in which the height access device 60 manages end of travel/limit of travel decisions is different as appropriate because the top position varies and depends on the number of mast elements 8 already in place; the manner of detection and decision making may notably be based on detecting the presence of the rail-ladder 26.

In an analogous manner, the lift cabin 11-working platform 12 assembly is usable during the dismantling of the mast 3, being progressively lowered as and when mast elements 8 are removed and being brought to the level of the next mast element 8 to be removed.

Also in this other operating mode, and therefore during assembling or dismantling, the lift cabin 11 remains temporarily separable from the immobilized working platform 12 to enable the ascent of persons to the platform or return of these persons to the ground.

A manual switch provided on the first control station 27 situated in the lift cabin 11 commands the change from the normal operating mode to the assembly/dismantling mode.

Figure 13:
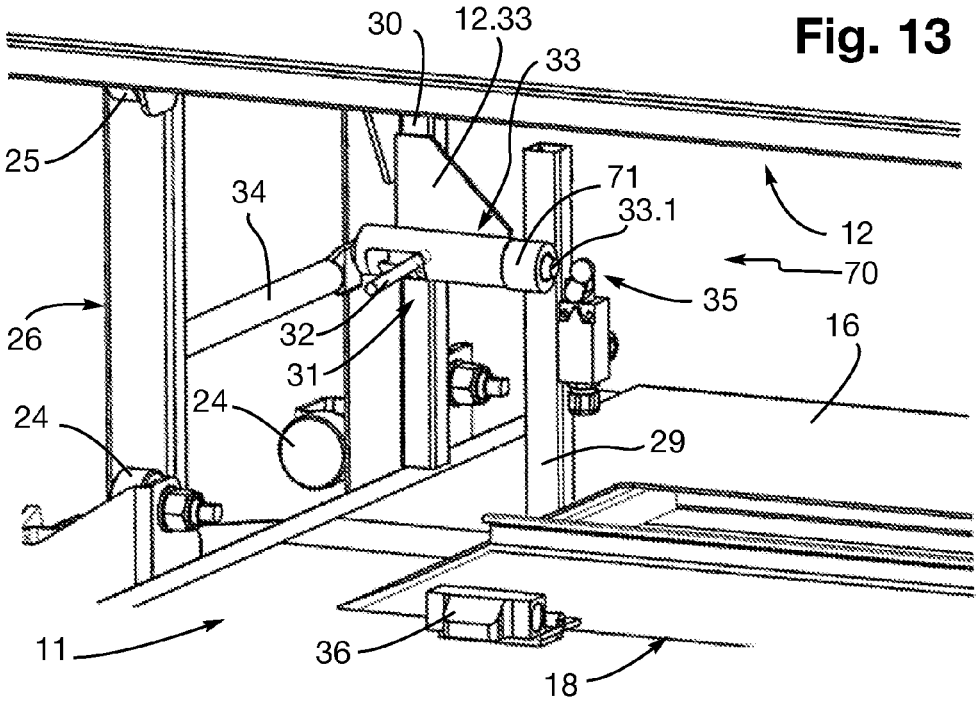
FIG. 13 is a perspective view showing in detail the coupling device between the working platform and the lift cabin in a coupled position.

Finally, referring to FIGS. 13 and 14, there will be described an embodiment of a manual coupling device 70/80 for detachably fastening the working platform 12 to the lift cabin 11 in a non-permanent manner. Here the coupling device 70/80 comprises latch 33 oriented horizontally and directed toward the rail-ladder 26, the latch 33 configured to be operable through the top trapdoor 18 of the lift cabin 11. FIG. 13 illustrates a part of height access device 60, whereas the left portion of FIG. 14 further shows parts of some truss members of mast 3 along with height access device 60 located inside mast 3.

In the coupled position (FIG. 13), the latch 33 detachably fastens the working platform 12 to the lift cabin 11 when the latch 33 is moved away from the rail-ladder 26. In the locked position (FIG. 14), the latch 33 unfastens the working platform 12 from the lift cabin 11. This latch 33 then engages with a rung 34 of the rail-ladder 26 so as to retain the working platform 12 at the required height. As visible on FIGS. 13 and 14, latch 33 has a first latch portion 33.1 and a second latch portion 33.2. The coupling device 70 further includes a catch 71 adapted to engage first latch portion 33.1. Catch 71 is attached to lift cabin 11 via an element 29 herein in the shape of a post anchored to the roof 16. Latch 33 is attached to working platform 12, via an attachment plate 12.33 and an element 30 herein in the shape of a post anchored to the platform floor 21. Between the coupled position (FIG. 13) and the locked position (FIG. 14), the latch 33 is selectively movable such that: i) when coupling device 70/80 is in the coupled position (FIG. 13), the first latch portion 33.1 engages the catch 71, so that coupling device 70/80 couples and detachably fastens lift cabin 11 and working platform 12; and ii) when coupling device 70/80 is in the locked position (FIG. 14), the second latch portion 33.2 engages the rail-ladder 26 of the mast 3, so that the coupling device 70/80 immobilizes working platform 12 relative to mast 3 at a required height. In service, the operator can actuate lever mechanism 31 by rod 32 in order to move the latch 33 selectively between: i) the catch 71 so as to reach the coupled position (FIG. 13) and ii) the rail-ladder 26 so as to reach the locked position (FIG. 13).

As FIGS. 13 and 14 show further, the latch 33 is connected with an electrical switch 35 fastened to the lift cabin 11 so that:

- in the coupled position with the working platform 12 detachably fastened to the lift cabin 11, the lift cabin 11-working platform 12 assembly can move along the mast 3 only at low speed;
- in the locked position with the working platform 12 immobilized and the lift cabin 11 able to move separately on its own, the lift cabin 11 can move along the mast 3 at higher speed.

FIG. 13 also illustrates a sensor 36 associated with the top trapdoor 18 of the lift cabin 11 to prohibit any movement of the lift cabin 11 if the top trapdoor 18 is not closed correctly.

Clearly, these elements can operate both in normal operation of the tower crane and in the assembly/dismantling modes, as described above.

The scope of the invention, as defined by the appended claims, is not exceeded:

- by modifying the constructional details of the lift cabin 11 and of the working platform 12;
- by providing any appropriate motor for the motorized movement of the lift cabin 11 along the mast 3;
- by replacing the manual coupling device 70/80 for non-permanent connection of the working platform 12 to the lift cabin 11 with a motorized coupling device 70/80, and by using any form of these manual or motorized coupling devices;
- by modifying or adapting the equipment of the lift cabin 11 and of the working platform 12, notably by replacing the inclined interior ladder 19 of the cabin with a vertical ladder or by adding a protecting guard rail for the bottom trapdoor 17 of the lift cabin 11;
- by providing any additional equipment useful to the operation and the safety of the height access device 60;
- by fitting the height access device 60 to a particular tower crane, for example a tower crane with a mast of varying section or a tower crane with anchor or stay frames suitable for use with the lift cabin 11 and the working platform 12 that move over only a fraction of the total height of the mast.

The invention claimed is:

1. A motorized height access device for tower cranes that include a mast, said motorized height access device comprising:

a lift cabin configured to be arranged inside said mast, said lift cabin being configured to be movable vertically along said mast when said lift cabin is arranged inside said mast;

a working platform having a guard rail and positioned above said lift cabin, said working platform being configured to be arranged inside said mast, wherein said working platform is separably connected to said lift cabin; and a coupling device configured:

for detachably fastening said working platform to said lift cabin when said coupling device is in a coupled position, such that said working platform is above said lift cabin when said coupling device is in said coupled position, and for unfastening said working platform from said lift cabin when said coupling device is in a locked position, said coupling device being further configured to immobilize said working platform relative to said mast at a required height when said coupling device is in said locked position, thereby enabling use of said lift cabin alone for height access when said lift cabin is unfastened from said working platform.

2. The motorized height access device of claim 1, wherein said coupling device is configured to be manually operated to or from said coupled position respectively from or to said locked position.

3. The motorized height access device of claim 2, wherein said coupling device is arranged to be operable from at least one of inside said lift cabin and from said working platform.

4. The motorized height access device of claim 3, wherein said lift cabin includes a cabin roof having a top trapdoor, and wherein said coupling device is arranged to be operable via said top trapdoor in said roof.

5. The motorized height access device of claim 3, wherein said coupling device includes a lever mechanism actuable by a rod that is arranged to be operable from inside said lift cabin.

6. The motorized height access device of claim 1, further comprising a latch, said latch having a first latch portion and a second latch portion, wherein said coupling device includes said first latch portion and said second latch portion, wherein said coupling device further includes a catch adapted to engage said first latch portion, said catch being attached to said lift cabin, said latch being attached to said working platform, said latch being selectively movable such that:

when said coupling device is in said coupled position, said first latch portion engages said catch, so that said coupling device detachably fastens said lift cabin to said working platform, and when said coupling device is in said locked position, said second latch portion engages a rail-ladder of said mast, so that said coupling device immobilizes said working platform relative to said mast at a required height.

7. The motorized height access device of claim 6, wherein said latch is connected with an electrical switch configured to detect said coupled position of said first latch portion and said locked position of said first latch portion, said electrical switch being further configured to permit a reduced speed of travel of said lift cabin when said switch detects said coupled position and to permit a non-reduced speed of travel of said lift cabin when said switch detects said locked position.

8. The motorized height access device of claim 1, wherein said coupling device is capable of being used with a motor configured to operate said coupling device to or from said coupled position respectively from or to said locked position.

9. The motorized height access device of claim 1, wherein said lift cabin further includes:

a cabin floor having a bottom trapdoor, a cabin roof having a top trapdoor, and an interior ladder extending between said cabin floor and said cabin roof, and wherein said working platform includes a platform floor with a platform trapdoor, said platform trapdoor being arranged to open onto said top trapdoor.

10. The motorized height access device of claim 9, wherein said interior ladder is inclined.

11. The motorized height access device of claim 1, further comprises at least one of a first control station arranged in said lift cabin, a second control station configured to be arranged at the base of said tower crane, and a third control station arranged on said working platform, each one of said first, second and third control stations being configured to control an ascent and a descent of said lift cabin.

12. A tower crane including a mast and a motorized height access device, said motorized height access device comprising:

a lift cabin configured to be arranged inside said mast, said lift cabin being configured to be movable vertically along said mast when said lift cabin is arranged inside said mast;

a working platform having a guard rail and positioned above said lift cabin, said working platform being configured to be arranged inside said mast, wherein said working platform is separably connected to said lift cabin; and a coupling device configured:

for detachably fastening said working platform to said lift cabin when said coupling device is in a coupled position, such that said working platform is above said lift cabin when said coupling device is in said coupled position, and for unfastening said working platform from said lift cabin when said coupling device is in a locked position, said coupling device being further configured to immobilize said working platform relative to said mast at a required height when said coupling device is in said locked position, thereby enabling use of said lift cabin alone for height access when said lift cabin is unfastened from said working platform.

13. A method of using the motorized height access device of claim 1, said method comprising:

operating the motorized height access device installed inside the mast of one of the tower cranes;

placing the coupling device in the coupled position; and moving the lift cabin and the working platform that are fastened together in the coupled position to a level of the mast to be at least one of assembled or dismantled.

* * * * *